United States Patent [19]

Rosen

[11] 3,943,945

[45] Mar. 16, 1976

[54] PROCESS FOR PREPARATION OF RECONSTITUTED TOBACCO SHEET

[75] Inventor: William E. Rosen, Lafayette Hills, Pa.

[73] Assignee: Rosen Enterprises, Inc., Lafayette, Pa.

[22] Filed: Sept. 22, 1972

[21] Appl. No.: 291,248

Related U.S. Application Data

[63] Continuation-in-part of Ser. No. 182,183, Sept. 20, 1971, abandoned, and a continuation-in-part of Ser. No. 279,857, Aug. 11, 1972, Pat. No. 3,889,689.

[52] U.S. Cl. ..... 131/140 C; 131/17 A; 131/2

[51] Int. Cl.[2]... A24B 1/92; A24B 3/12; A24B 9/00; A24B 15/00

[58] Field of Search ..... 131/2, 17, 140–144, 131/17 A, 140 C

[56] References Cited

UNITED STATES PATENTS

| | | | |
|---|---|---|---|
| 1,996,797 | 4/1935 | Dreyfus | 131/140 P X |
| 2,656,841 | 10/1953 | Gurley, Jr. | 131/140 P |
| 2,904,840 | 9/1959 | Hochreuter et al. | 264/54 |
| 2,913,769 | 11/1959 | Kastli | 131/140 P |
| 3,240,214 | 3/1966 | Bavley | 131/141 |
| 3,364,935 | 1/1968 | Moshy et al. | 131/140 P |
| 3,612,065 | 10/1971 | Rosen | 131/140 P |
| 3,771,533 | 11/1973 | Armstrong et al. | 131/140 P |

OTHER PUBLICATIONS

"Chemical Abstracts" Vol. 75, No. 4, July 26, 1971 p. 30537.

*Primary Examiner*—Robert W. Michell
*Assistant Examiner*—V. Millin
*Attorney, Agent, or Firm*—Stephen E. Feldman

[57] ABSTRACT

An improvement in the production of all reconstituted tobacco sheet material is described which involves the reaction in situ of catalase and hydrogen peroxide within the mass of ingredients, including tobacco, which are ultimately formed into the finished reconstituted tobacco sheet.

8 Claims, No Drawings

PROCESS FOR PREPARATION OF RECONSTITUTED TOBACCO SHEET

CROSS REFERENCE TO RELATED APPLICATIONS

This application is a continuation-in-part of my copending application Ser. No. 182,183, filed Sept. 20, 1971 now abandoned, and is a continuation-in-part of my copending application Ser. No. 279,857 filed Aug. 11, 1972, entitled Method of Treating Tobacco with Catalase and Hydrogen Peroxide now U.S. Pat. No. 3,889,689.

BACKGROUND OF THE INVENTION

Field of the Invention

This invention relates to the manufacture of reconstituted tobacco sheet, and more particularly relates to a method for improving the quality and economic usefulness of reconstituted tobacco sheet in finished smoking products.

It is known that by 1964, at least fifteen percent of the tobacco incorporated into domestic smoking products was formed from reconstituted tobacco sheet. There is no single definition for reconstituted tobacco sheet, since the term indicates any extended web, film or sheet of material containing tobacco which has been formed by the aggregation of a plurality of relatively small particles of tobacco (e.g. dust, fines, waste, shreds etc), with or without additional materials. The basic known processes for forming reconstituted tobacco sheet are as follows:

1. Dust-impingement.
2. Tobacco slurry.
3. Impregnation-of-web.
4. Paper.
5. Extrusion.

The dust-impingement process involves impinging ground tobacco upon an adhesive surface, and then drying the mixture. The tobacco slurry process involves forming a dispersion of ground tobacco in a solution containing such materials as adhesive, ash additives, humectants and reinforcing fibers, and casting the slurry onto a smooth surface such as a roller or plate, where it is dried into a continuous sheet. The impregnation-of-web process involves impregnating a sheet or web of carrier material such as paper or other cellulosic product with a finely divided mixture of tobacco. The paper process involves forming a tobacco sheet from tobacco fibers in a manner similar to the conventional process of forming paper from cellulosic fibers. The extrusion process involves the mechanical extrusion of a mass containing finely divided tobacco particles into a continuous sheet. This sheet may also contain adhesives, ash additives, humectants, reinforcing fibers and the like. In my copending application filed Aug. 11, 1972, the disclosure of which is incorporated herein by reference and made a part hereof, I have described a method of treating tobacco in which physical force is used to cause liquid containing catalase and hydrogen peroxide to permeate the interstices of tobacco where they are reacted with each other in situ, enhancing properties of the tobacco. The forms of tobacco treated in accordance with that process are whole leaf, lamina, cut ribs and stems, and finished reconstituted tobacco sheet. I have now discovered that the basic tobacco ingredients (e.g. dust, fines, waste, shreds etc.) which are utilized by all processes for making reconstituted tobacco sheet may be also treated by the in situ reaction of catalase and hydrogen peroxide during the transformation of these ingredients into a finished reconstituted tobacco sheet.

Summary of the Invention

The process of my invention comprises the steps of (1) thoroughly mixing a plurality of finely divided tobacco particles in a liquid solution containing catalase and hydrogen peroxide (2) allowing said catalase and hydrogen peroxide to react in situ in the presence of the tobacco and (3) forming said solution containing tobacco particles into a finished sheet tobacco product.

EXAMPLE 1

One part of ground tobacco was added to 20 parts of water and homogenized in a blender to form a slurry. 5 percent by weight of this slurry of a 12 percent hydrogen peroxide solution was added along with 5 percent by weight of the slurry of a 2 ml per liter of water solution of catalase. After thorough mixing the slurry was added to an autoclave and cooked at 15 p.s.i.g. for 10 minutes. The slurry, in the form of a dough, was spread in a film of approximately 5 mm thickness on stainless steel plates and dried over a steam bath. When dry each sheet was porous, strong, mild flavored, and darker in color than the original ground tobacco.

EXAMPLE 2

Example 1 is repeated, except that additionally to the slurry is added 5 percent by weight of the slurry of carboxymethylcellulose. The finished sheet tobacco had the same qualities as the product of Example 1, and in addition was more resistant to tearing.

Other binding agents in addition to carboxymethylcellulose which may effectively be used in the process of this invention are methyl cellulose and pectin.

The process of this invention may be used in combination with any of the conventional processes for making reconstituted tobacco sheet filler, binder or wrapper.

One advantage of the process of this invention is the possibility of utilizing the reconstituted sheet product thereof in proportions of a finished smoking product approaching one hundred percent. This is due to the low density sheet formed and increased strength of the sheet, as well as the mild nature of the treated tobacco. Moreover, since the catalase and hydrogen peroxide reaction converts some cellulose components of tobacco into sugars, the hygroscopicity of the finished product is increased, thereby improving the shelf life of the finished tobacco product.

It will readily be apparent that delayed catalase may be advantageously used in accordance with the process of this invention. Such use will permit thorough mixing of the tobacco particles in the liquid solution containing catalase and hydrogen peroxide before the onset of the in situ reaction. It is also advantageous in accordance with the process of this invention, to apply negative pressure by means of vacuum devices either to the untreated tobacco or to the reaction mixture at some point in time after the in situ reaction between catalase and hydrogen peroxide has been started. When applied to the untreated tobacco, the interstices of the tobacco are cleared by the negative pressure, permitting more complete perfusion of the reaction mixture. When applied after the start of the in situ reaction, the negative pressure aids in the expansion of the mixture to give a porous reconstituted tobacco sheet.

Having thus described my invention, I claim:

1. In a process of producing reconstituted tobacco sheet including the steps of (1) evenly distributing a plurality of finely divided tobacco particles throughout a spatial zone, and (2) thoroughly mixing said tobacco particles in a liquid solution containing catalase and hydrogen peroxide, (3) allowing said catalase and hydrogen peroxide to react in situ at ambient temperature and pressure in the presence of the tobacco and (4) causing said tobacco to aggregate into a self-supporting sheet.

2. The process according to claim 1, wherein the tobacco particles are caused to aggregate into a self-supporting sheet by means of an adhesive.

3. The process according to claim 1, wherein the tobacco particles are caused to aggregate into a self-supporting sheet by impregnating said particles in a self supporting web.

4. The process according to claim 1, wherein the tobacco particles are caused to aggregate into a self-supporting sheet by the mutual interengagement of said particles.

5. The process in accordance with claim 1, wherein the amount of catalase and the amount of hydrogen peroxide are sufficient to decompose the catalase and the hydrogen peroxide.

6. The process in accordance with claim 1, wherein the catalase is delayed catalase.

7. The process in accordance with claim 1, wherein the in situ reaction of catalase and hydrogen peroxide is carried out at least in part under super-atmospheric pressure.

8. The process in accordance with claim 7, wherein said tobacco is caused to aggregate into a self-supporting sheet after release of said super-atmospheric pressure.

* * * * *